United States Patent [19]

Wolf

[11] 4,355,740

[45] Oct. 26, 1982

[54] CONTAINER HOLDER AND ACTUATOR FOR AEROSOL CANS

[75] Inventor: David Wolf, Newton, Mass.

[73] Assignee: Scott's Liquid Gold, Inc., Denver, Colo.

[21] Appl. No.: 194,375

[22] Filed: Oct. 6, 1980

[51] Int. Cl.[3] ..... B65D 83/14

[52] U.S. Cl. ..... 222/180; 222/183

[58] Field of Search ..... 222/180, 182, 183, 184, 222/186, 402.13, 402.15, 181

[56] References Cited

U.S. PATENT DOCUMENTS 2,998,165 8/1961 De Elorza ..... 222/183 X 3,100,065 8/1963 Gross ..... 222/180

3,209,796 10/1965 Silletti ..... 222/182 X

*Primary Examiner*—Stanley H. Tollberg

*Attorney, Agent, or Firm*—Wolf, Greenfield & Sacks

[57] ABSTRACT

A container holder for air freshener, deodorizer or other conventional household aerosol cans. The container holder is wall mountable and comprises a holder body into which the container is placed and a cover portion which is slideably mounted onto the holder body. As the cover is pushed in the downward direction a tongue located on the inside surface of the cover top causes the container valve to actuate releasing a spray of the container contents into the environment. Upon release of the cover, the cover springs upward to its rest position causing the container valve to shut.

4 Claims, 3 Drawing Figures

CONTAINER HOLDER AND ACTUATOR FOR AEROSOL CANS

BACKGROUND OF THE INVENTION

The present invention relates to an apparatus for dispensing the contents of pressurized aerosol cans.

DESCRIPTION OF THE PRIOR ART

Prior wall holders for aerosol cans such as the holder disclosed in U.S. Pat. No. 4,111,338 normally have a cover or lever pivotally mounted to the holder body. The cover or lever is pitovally mounted to the holder body with bolts, hinges and the like forming a moveable joint between the holder cover and body. When hinges or bolts are used to connect the cover of the holder to the holder body, the appearance of the apparatus is awkward since the cover protrudes from the holder body as shown in the drawings of U.S. Pat. No. 4,111,338. The use of the hinge fasteners unnecessarily complicates the design and fabrication of the holder, resulting in added costs. Furthermore, the hinges connecting the cover to the holder body may wear or break on frequent use or on application of excessive hand force to depress the cover.

SUMMARY OF THE INVENTION

It is an object of the present invention to provide a wall holder for dispensing the contents of pressurized aerosol cans, with the holder having a slender, streamlined design and a minimum of mechanical parts.

The wall holder of the present invention is designed to hold aerosol cans for dispensing room air fresheners, insecticide repellent, smoke deodorizers and the like. The wall holder consists of a cover portion and a holder body. The holder body is attachable to the wall of a room or bathroom by screw means or adhesives. An aerosol can is placed upright in an opening of the holder body. The holder body is formed with rails on the outer surface of its sidewalls. The cover has grooves on the inner surface of each of its sides for engaging the rails of the holder body as the cover is slipped over it. As the cover is manually depressed, a tongue on the inside top surface of the cover actuates the can nozzle. When the nozzle is actuated, a spray is emitted to the environment through an opening in the cover.

DETAILED DESCRIPTION

Figure 1:
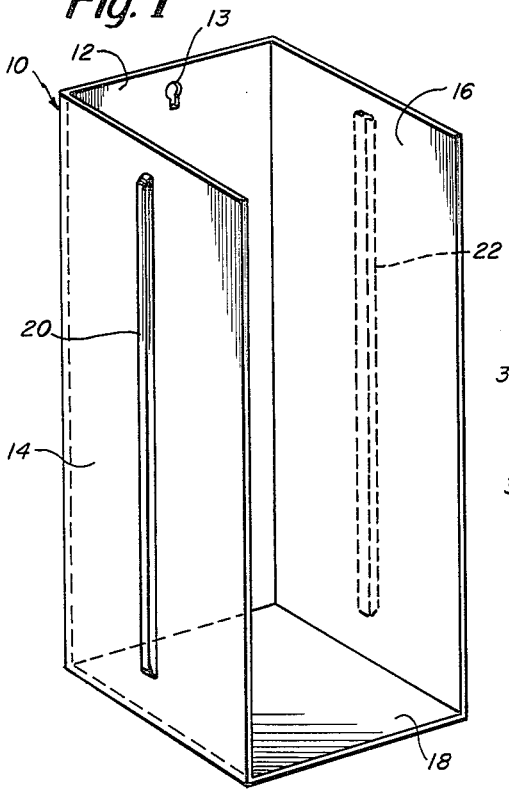
FIG. 1 is a perspective view of the holder body of the present invention.

The wall holder of the invention in FIG. 1 includes a holder body 10 and a cover 30. The holder body 10 is preferably rectangular as shown in FIG. 1, but may also be of cylindrical shape. The holder is formed by sidewalls 14 and 16, a back wall 12 and a bottom 18. A key hole 13 in the back wall is shaped to receive a screw or fastening means for affixing the holder body to a wall. Alternatively, the holder body may be attached to the wall by adhesive applied to the outer surface of the backwall 12.

Rails 20 and 22 are located on each of the sidewalls 14 and 16 respectively. The rails 20 and 22 run substantially along the vertical length of the holder body and protrude slightly from the sidewall surface. The holder body may be comprised of common plastic material such as polyethylene or polystyrene. The rails are preferably integrally molded with the holder body, but they may also be made of different material, such as metal and glued or fastened to the sidewalls.

Figure 2:
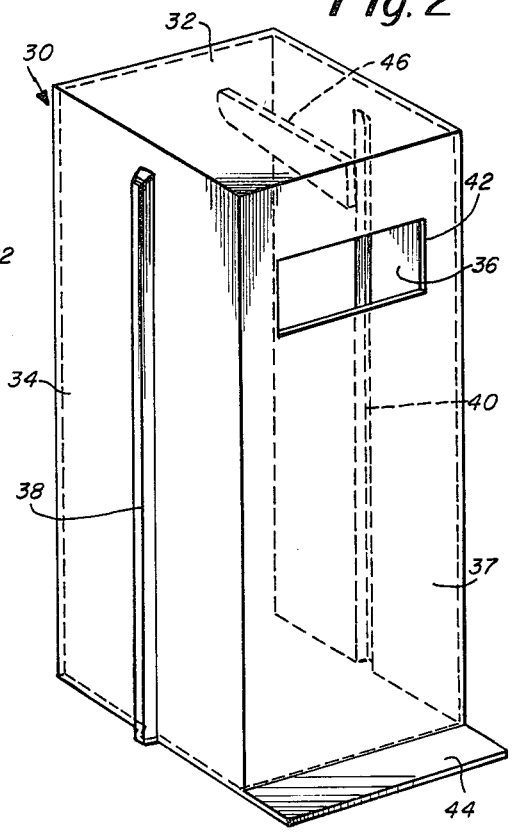
FIG. 2 is a perspective view of the cover for the holder body.
Figure 3:
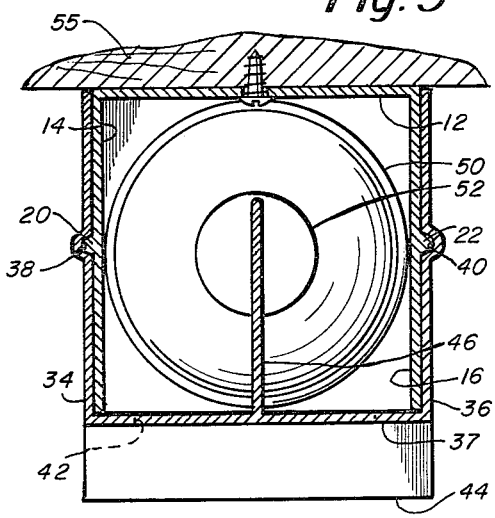
FIG. 3 is a top view of the holder body with aerosol can positioned therein and cover engaging the holder body.

The slideable cover 30 for the holder body shown in FIG. 2 is shaped to conform into the holder body 10. In the preferred embodiment, it is rectangular in shape. However, it should be semicylindrical in shape if the holder body is cylindrical. The cover 30 is formed with a top 32, sidewalls 34 and 36, and a front 37. An opening 42 is formed in the upper portion of the front 37. Grooves 38 and 40 are located on the inside surface of sidewalls 34 and 36 respectively and are shaped to receive rails 20 and 22 in sliding fit. The grooves extend vertically along the length of the sidewalls and protrude outwardly from the sidewalls. A tongue 46 protrudes downwardly from the inner surface of the top 32. The tongue protruding downwardly from the top 32 may be of varied configuration such as of rectangular or circular shape and of varied lengths and width. A preferred configuration for the tongue is that of a rectangular bar located about midway between the sidewalls 34 and 36 and passing from near the front edge of top 32 to or in close proximity to the central axis of the cover 30. A manual depression means such as lip 44 is affixed to and protrudes outwardly from the cover. Preferably the lip 44 is positioned near the lower edge of the front surface 37 and is of sufficient width and length to allow convenient placement of one or more fingers. The cover 30 together with the tongue 46, grooves 38 and 40 and the lip 44 may preferably be cast molded from plastic material such as polyethylene or polystyrene plastic. In use, the can holder body 10 is first fastened to a wall by affixing the back surface 12 to the wall surface by screw means or adhesive. An aerosol can is then placed into the holder body so that the bottom of the can rests against the bottom 18. The slideable cover 30 is then placed over the holder body 10 so that rails 20 and 22 of the holder body engage grooves 38 and 40 of the sidewalls of the cover. The cover is slid down along the rails until tongue 46 comes to rest against the valve means 52 conventionally located at the top of an aerosol can. In order to obtain spray from the contents of the can, finger pressure may be exerted downwardly on lip 44 whereupon the cover slides downwardly along rails 14 and 22 causing the tongue 46 to actuate valve 52 of the can. The can contents then sprays from the can nozzle (not shown) through opening 42 and into the environment. On relase of lip 44 the cover springs upwardly causing valve 52 to shut. Small plastic leaf springs or the equivalent may be affixed to the inside of the top surface 32 of the cover to facilitate the movement of the cover upon release of the lip 44.

While the present invention has been described with reference to a specific preferred embodiment, it should be appreciated that other arrangements are possible without departing from the concept of the invention. The invention is intended to be limited only by the language of the claims and equivalents thereof.

What is claimed is:

1. A holder apparatus for retaining and engaging pressurized cans, said pressurized cans having a valve and nozzle located on the can, said holder apparatus adapted to be wall-mountable and comprising a holder body adapted to hold a pressurized can, a removable cover, extension means within the cover for engaging the valve of the pressurized can when said cover moves downward relative to said holder body, and means for slideably mounting the cover over the holder body, including at least one longitudinally extending rail and a longitudinally extending groove for receiving said rail with one of said rail and groove on the inside surface of said cover and the other on the outside surface of said holder body, so that when the cover is placed onto the holder body, the rail engages said groove to produce a slideable fit between the cover and the holder body.

2. A holder apparatus as in claim 1 wherein the extension means is a tongue extending into the cover interior space in alignment with the valve of the pressurized can.

3. A holder apparatus as in claim 1 having grip means projecting from said cover for us in depressing said cover relative to said holder body.

4. A holder apparatus as in claim 1 wherein the cover is rectangular in shape and includes a top, two side walls and a front wall with an opening formed therein to permit a portion of the can contents to pass from within the holder body interior into the environment upon actuation of the valve affixed to the can.

* * * * *